United States Patent [19]

Rantell et al.

[11] Patent Number: 4,997,548

[45] Date of Patent: Mar. 5, 1991

[54] COAL EXTRACTION

[75] Inventors: Terry D. Rantell, Cheltenham, England; Geoffrey M. Kimber, Prestatyn, Wales; Gordon Dennison, Bromsgrove, England

[73] Assignee: Coal Industry (Patents) Limited, United Kingdom

[21] Appl. No.: 229,281

[22] Filed: Aug. 8, 1988

Related U.S. Application Data

[63] Continuation-in-part of Ser. No. 50,672, May 18, 1987, abandoned.

[30] Foreign Application Priority Data

Jun. 3, 1986 [GB] United Kingdom ..... 8613422

[51] Int. Cl.[5] ..... C10G 1/04

[52] U.S. Cl. ..... 208/408; 208/409

[58] Field of Search ..... 208/408, 409

[56] References Cited

U.S. PATENT DOCUMENTS 4,219,403 8/1980 Nakako et al. ..... 208/408

FOREIGN PATENT DOCUMENTS 2156841 10/1985 United Kingdom ..... 208/409

*Primary Examiner*—Asok Pal

*Attorney, Agent, or Firm*—Stevens, Davis, Miller & Mosher

[57] ABSTRACT

Recycled oil solvents for coal extraction have their content of saturated cyclic species reduced by thermal cracking at 470° to 540° C. for a few minutes, restoring their effectiveness as solvents for coal.

9 Claims, 1 Drawing Sheet

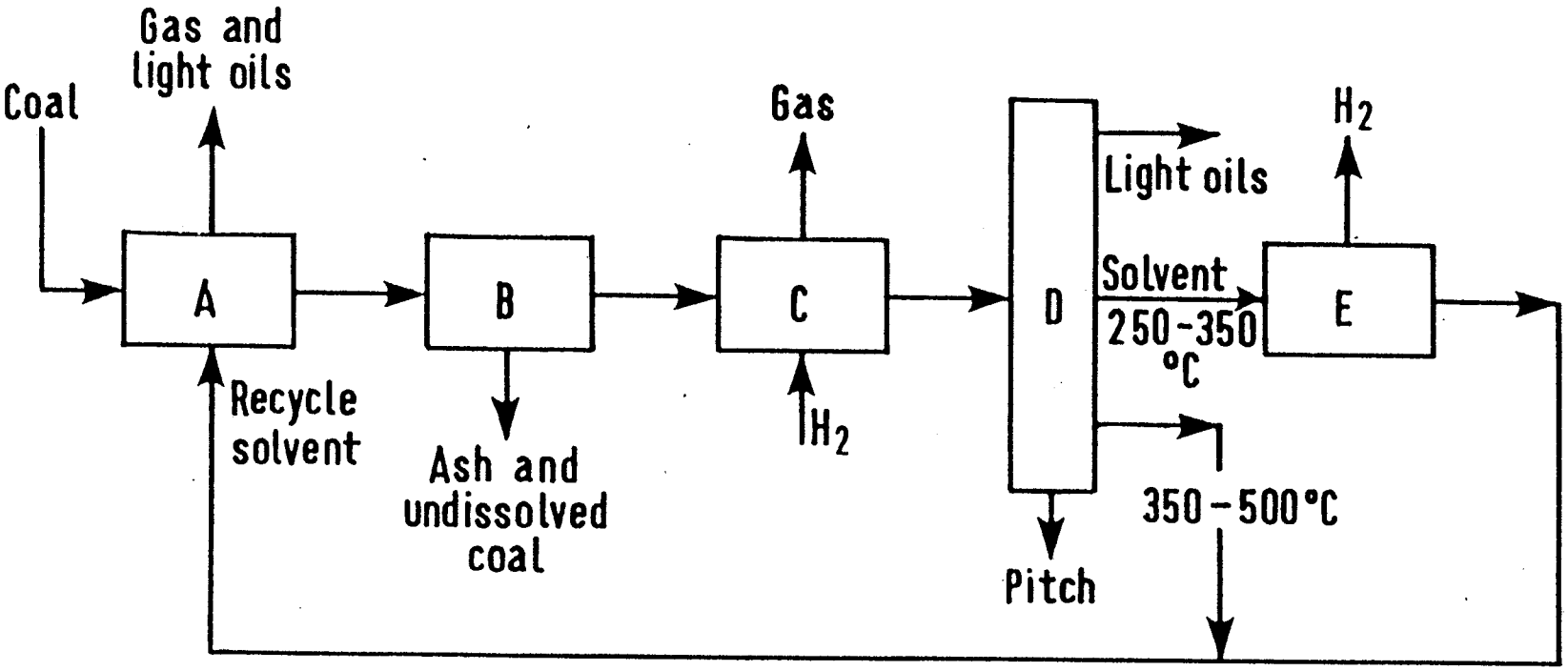
Coal
A
Gas and light oils
Recycle solvent
B
Ash and undissolved coal
C
Gas
$H_2$
D
Light oils
Solvent 250-350 °C
350-500°C
Pitch
E
$H_2$

COAL EXTRACTION

CROSS REFERENCE TO RELATED APPLICATIONS

The present application is a continuation-in-part of Ser. No. 050,672 filed May 18, 1987, now abandoned.

BACKGROUND OF THE INVENTION

1. Field of the Invention

This invention concerns improvements in coal extraction more especially it concerns the treatment of solvent for coal extraction.

2. Description of the Related Art

It is known, from our UK Patent Application No GB 2156841A, that it is desirable for efficient solvent extraction of coal to reduce the saturation of the recycled solvent, arising from over hydrogenation.

It is well-known that coals can be dissolved in oil-type solvents at high temperatures, and that improved yields can be obtained by the presence of hydrogen, under high to low pressures of hydrogen or through the use of so-called hydrogen donor solvents. Catalysts may be present.

Various processes have been suggested for the liquefaction of coal using a so-called hydrogen donor solvent. A hydrogen donor solvent can be defined as an oil or fraction of an oil boiling in the range 200°-500° C., which is essentially hydroaromatic in composition and can donate its chemically bound hydrogen to the depolymerizing coal at high temperature, stabilizing the coal extract produced by addiing the hydrogen to the coal radicals, and thus preventing the radicals from forming coke.

A typical process, by way of example, for the liquefaction and destructive hydrogenation of coal, would consist of contacting crushed coal with a hydrogen donor solvent at high temperature in a first reactor to dissolve the coal, followed by filtration to remove ash and undissolved coal, in a second reactor the coal extract, together with the solvent or a fraction of the solvent, is contacted with a catalyst in a fixed bed together with hydrogen at high pressure and temperature. The coal extract is converted to distillable oils and the solvent is replenished with hydrogen donors. After fractionation of the products, the light oils can be further upgraded to gasoline, diesel and aviation fuels, and the hydrogen donor solvent can be recycled to the first reactor to dissolve more coal. Hence, the process can be made continuous and independent of external sources of solvent.

A problem with the above-described process is the high pressure of hydrogen required to convert adequately the coal extract in the second reaction and to prevent coking at the high reactor temperature. The high hydrogen pressure tends to give a recycle solvent which becomes saturated with hydrogen on multiple passes through the second reactor. Compounds such as alkyl decalins, perhydrophenanthrene and perhydropyrene are formed on repeated cycles. These compounds are paraffinic in nature and can cause precipitation of the dissolved coal extract leading to precipitates blocking process lines.

Furthermore, the saturated compounds are poor hydrogen donors relative to the hydroaromatic compounds, which leads to lower extraction yields.

The saturates in the recycle solvent could, in theory, be removed by a number of methods, for instance liquid/liquid extraction or reaction of the saturates with elemental suphur or selenium. Liquid/liquid extraction is inconvenient and leads to a loss of solvent from the process. Reaction with sulphur requires large quantities of the element and produces a large quantity of hydrogen sulphide which is undesirable.

Another approach to the problem of over-hydrogenation of the recycle solvent is described in British Patent Application Number 82/03640. A solvent consisting of aromatic polycyclic hydrocarbons of three and/or four ring molecules and at least 25% of saturated naphthenes boiling in the range 180°-300° C. is employed. The aromatic portion of the solvent in the process is removed by distillation after extraction of the coal so that it does not pass through the hydrocraker and subsequently saturates are not allowed to increase on repeated recycle.

According to GB-A-2156841 coal liquefaction processes employing hydrogen donor solvents are improved by dehydrogenating the saturates contained in the recycle solvent or a fraction of it to hydroaromatics thus removing the chemical entites which cause precipitation of coal extract without losing solvent balance in the overall hydroliquefaction process. Dehydrogenation of the saturates to hydroaromatics enables the process to operate without the problem of precipitates in process lines and advantageously enables the hydrocracker to operate at high pressures, for instance 200 atmospheres, which are necessary to achieve high conversion of coal extract in the presence of the hydrogen donor solvent.

GB-A-2156841 therefore provides a method of coal liquefaction in which coal is extracted using a liquid hydrogen donor solvent at elevated temperature and pressure at least a fraction of the extract and at least a fraction of the solvent are hydrogenated together or separately and at least a portion of the hydrogenated solvent is recycled to the extraction, characterised in that part at least of the solvent is catalytically dehydrogenated to reduce the quantity of cyclic saturates. The part of the solvent which is catalytically dehydrogenated may be taken from any point of the cyclic liquefaction process, and the dehydrogenation may be carried out continuously or intermittently.

The part of the solvent which is dehydrogenated would contain between 5 and 95% of weight of saturates, but preferably contained 10 to 20% of saturates, and it might contain 95 to 5% by weight of aromatics, but the aromatic content was preferably rather low, for example 5 to 25%. It was preferred to dehydrogenate saturates to hydroamatics, since it was thought that aromatics might inhibit the catalyst.

The catalytic dehyrogenation could be carried out in a method analogous to the reforming of naphtha in petroleum oil refineries. It was not the practice, however, to reform factions having the chemical composition of the hydrogenated solvent, nor did naphtha have similar cut points. The catalyst had to be capable of converting cyclic saturates to hydroaromatics, and would also thus convert hydroaromatics to aromatics although this latter reaction was less desirable. A careful selection by testing was, however, necessary since nickel/molybdenum or alumina converted hydroaromatics to aromatics but cyclic saturates were unconverted. Preferred catalysts included platinum and/or palladium on alumina, silica or active carbon at a loading of 0.1 to 10%, preferably 0.2 to 1% by weight;

these readily promoted the dehydrogenation of saturates such as decalins to tetralins, perhydrophenanthrenes to octa-and tetra-hydrophenanthrenes and perhydrophyrenes to hexa- and di-hydropyrenes. Another preferred catalyst was chromia on alumina. The catalyst could be used in a fixed of fluidised bed reactor.

The catalytic dehydrogenation was suitably carried out at pressures of from 1 to 40 bar, preferably 15 to 25 bar over a platinum catalyst and preferably 1 to 5 bar over a chormia catalyst and suitable temperatures are from 400° to 550° C., preferably 460° to 480° C. Flow-rates of hydrogenated solvent, measured as liquid hourly space velocity, were suitably 0.2 to 4.0 h-1, but tests over a platinum catalyst indicated that flow rates of 0.5 to 1.0 were most preferred. Hydrogen might require to be fed to the process in order to achieve a high hydrogen partial pressure. Hydrogen to solvent molar ratios (H2:HC) were suitably 3 to 20, but are preferably 5 to 10.

Dehydrogenation catalyst was susceptible to poisoning, especially by sulphur, and it was desirable to ensure that the solvent steam being treated was low in catalyst poisons. If the solvent stream to be treated was not sufficiently free from catalyst poisons, then it was preferred to desulphurise the stream, for example by hydrogenating over a Ni/Mo or Co/Mo catalyst; this way also effective to reduce the nitrogen content of the stream.

BRIEF DESCRIPTION OF THE DRAWINGS

The sole FIGURE is a flow design of a coal extraction plant.

SUMMARY OF THE INVENTION

In the accompanying figure which is a flow diagram of a coal extraction plant, finely divided bituminous or sub-bituminous coal of a particle size of below 200 um, is extracted in an extractor, A, with from 1 to 10:1, preferably 2:1 to 5:1, of its weight of a hydrogen rich high boiling oil. The temperatures and pressures used are preferably from 430° to 450° C. and 10 to 15 bar respectively, and the solid and liquid residence times are preferably about 30 and 120 minutes respectively. The coal extract slurry product from extraction stage A is passed to a solids removal stage, B, in which ash and undissolved coal are removed by filtration, centrifugation, vacuum distillation, setting or otherwise.

The coal extract solution, substantially free of solids, is passed to a catalytic "hydrocracking" stage, C, in which the coal extract is destructively hydrogenated to distillable oils and the solvent is hydrogenated to replenish the hydrogen donor components, which have given up hydrogen to coal derived moieties in the extraction step. Hydrocracking is so named because both high molecular weight carbonaceous material is cracked to lower molecular weight oils and at the same time hydrogen is chemically bound to the oils and solvent, and may be carried out in a fixed or moving bed, e.g. an ebullating bed, reactor. The catalyst used is suitably a sulphur-resistant hydrogenation catalyst, molybdenum or tungsten sulphide, promoted with mickel or cobalt, supported on alumina, alumina-silicates, silica, active carbon, magnesia, carbon, magnesia, chromia, titania etc. According to the present invention, the operating conditions of the hydrocracker are not limited by the need to avoid saturation of the solvent oil. Pressures of 50 to 700 bar, preferably 200-250 bar, and temperatures of 410° to 480° C. preferably 440° to 460° C., are therefore used to obtain optimum conversion of the heavy coal-derived material. Liquid hourly space velocities of 0.2 to 2.0 h-1, preferably 0.4 to 1.0 h-1, depending upon the concentration of dissolved coal material, may be used.

Gases, including C1–C4 hydrocarbons, H2S and NH3, are separated, and the liquid product is passed to a fractionation stage, D, which may be atmospheric or vacuum distillation unit. A separation is made between light product oils boiling from C5 to 250° C. or 300° C., pitch which is the non-distillable part of the products and a solvent fraction, suitably boiling between 250° C. and 350° C. In this embodiment, a heavy solvent fraction boiling between 350° and 500° C. is recycled without further treatment to the extraction step A.

The lighter solvent fraction is passed to a catalytic dehydrogenation stage, E. In this lighter fraction, the major proportion of the saturates in the solvent are found. Also, the dehydrogenation of a lighter fraction, rather than the whole of the solvent, enables the dehydrogenation to be carried out more efficiently in the gaseous phase instead of liquid phase. Suitable conditions etc for the catalytic dehydrogenation have been described above. Hydrogen is removed as a gaseous product and the treated solvent fraction is recycled to the extraction stage together with the untreated but hydrocracked heavy fraction.

We have now found an alternative method of controlling the concentration of saturated species in solvents for coal extraction.

The present invention provides a process for treating a high boiling hydrocarbon oil containing saturated cyclic species which comprises heat treatment of the oil at a temperature of from 470 to 540° C. for a time of from 2 to 15 minutes, whereby the concentration of saturated species is reduced.

DESCRIPTION OF PREFERRED FEATURES

In general, the conversion of saturated species increases both with temperature and with residence time, and loss of solvent oil in this manner is undesirable. Preferred conditions are therefore, temperatures of from 480 to 520° C. with residence times of 3 to 10 minutes. Increasing the operating pressure had a smaller affect on the conversion of saturates than increases in temperature and in temperature and in residence time. For example, a three-fold increase in pressure, from 8 to 25 bar, resulted in the conversion of the saturates in one feedstock increasing from 50 to 70% by weight. Other process variables are not considered to significantly affect the process, although, of course, feedstock analysis does affect the product.

Analysis of the gas made in the process has shown the presence of alkenes, and a relatively low level of hydrogen (e.g. 0.5–2wt%) indicates that the process of the invention involves predominantly thermal cracking, although some dehydrogenation may take place.

The oil treated according to the invention is suitably a recycled solvent oil in a liquid solvent coal extraction process. In general, the oil is a cut of the product of hydrocracking the coal solution, and may contain from about 25 to about 75% by weight of saturated species, not all of which will by cyclic. It may thus be a 250°–350° C. cut of the product of hydrocracking which is the solvent fraction described above with reference to GB-A-2156841. The oil may be heat treated together with another product of the coal extraction process, including products of subsequent processing. It may be desirable in a coal extraction process to treat part only of the solvent cut and to blend the reduced saturated content product with other solvent components before use as the recycled solvent.

The process of the invention may be carried out in economic manner, using, for example, a delayed coking vessel. It is carried out in the absence of hydrogen and under autogenously generated pressure, although pressure is less significant than residence time. No hydrogen is fed to the reactor and it is operated at relatively low pressures e.g. pressures below 50 bar(g), preferably pressure below 20 bar(g) and particularly below 10 bar g. Pressure is used only as a means for varying the treatment time.

The invention also provides a coal extraction process, comprising the use as a recycled solvent, of an oil treated according to the invention.

The invention will now be described by way of example only.

EXAMPLE I

Oil samples were taken from the recycle solvent cut from the hydrocracker of a pilot plant coal extraction process. The samples were charged into a minibomb reactor heated in a fluidised sand bath. At the end of the treatment period, the reactor was quenched with water and the gas and liquid products were analysed using conventional chromatographic and spectroscopic analytical techniques.

The results of treatment for two feedstocks, together with analysis and characterisation of untreated feedstock and the pressures which were generated during the process, are shown in Table I. It should be noted that the pressures were not fixed but were generated autogenously as a result of vaporisation at the reaction temperature and gas produced as a result of the cracking of saturates. No hydrogen was fed to the reactor which operates at relatively low pressures

TABLE I

| | Treatment Temp (°C.) | Treatment Time (Min) | Gas Yield % | Saturates (%) | n-alkanes (% of sats) | H (%) | % Change in Sats | Treatment Pressure bar |
|---|---|---|---|---|---|---|---|---|
| SAMPLE 1 | UNTREATED | | — | 16.1 | 32 | 8.6 | — | — |
| | | | (%) | | | | | |
| | 475 | 3 | 0.4 | 14.3 | 36 | 8.3 | 11 | 2.4 |
| | | 5 | 0.6 | 14.4 | 35 | 8.6 | 11 | 5.2 |
| | | 8 | 1.1 | 13.3 | 30 | 8.4 | 17 | 10.0 |
| | 500 | 3 | 2.7 | 11.2 | 38 | 8.0 | 30 | n.a. |
| | | 5 | 3.0 | 10.0 | 37 | 7.9 | 38 | 9.7 |
| | | 8 | 3.9 | 4.5 | 39 | 7.3 | 72 | 25.9 |
| | 525 | 3 | 3.0 | 8.1 | 34 | 7.8 | 50 | 20.0 |
| | | 5 | 4.4 | 3.9 | 32 | 7.3 | 76 | 34.5 |
| | | 8 | 6.1 | 1.1 | 21 | 6.6 | 93 | n.a. |
| | UNTREATED | | — | 22.2 | 33 | 10.4 | — | — |
| | 475 | 8 | 1.9 | 18.1 | 33 | 9.5 | 18 | n.a. |
| | 500 | 3 | 1.0 | 19.3 | 35 | 9.6 | 13 | n.a. |
| | | 5 | 2.2 | 16.1 | 34 | 9.4 | 59 | n.a |
| | | 8 | 4.5 | 9.2 | 28 | 9.1 | 59 | 17.9 |
| | 525 | 8 | 9.2 | 2.6 | 30 | 8.0 | 88 | n.a. |

n.a. = not applicable

EXAMPLE II

Oil samples as in Example I were fed into a continuously operating "satcracker" of 5 liters capacity at the temperatures and pressures and for the residence times indicated in Table II. The product of each run was analysed as described in Example I, Saturates reduction ranged up to 50% for temperatures up to 520° C. and pressures up to 8 bar.

TABLE II

| Temperature °C. | Residence Time/Min. | Pressure bar (g) | Gas Yield % Feed | Saturates in Feed, % W/W | % Reduction In Saturates |
|---|---|---|---|---|---|
| 500 | 8.3 | 2.2 | 3.3 | 27.8 | 42 |
| 520 | 3.0 | 0.0 | 2.6 | 27.4 | 25 |
| 500 | 3.2 | 0.0 | 1.0 | 28.2 | 16 |
| 500 | 2.9 | 1.0 | 0.7 | 28.1 | 14 |
| 520 | 2.7 | 1.0 | 1.9 | 28.1 | 24 |
| 500 | 4.7 | 8.0 | 2.8 | 23.4 | 33 |
| 500 | 7.6 | 2.0 | 3.4 | 28.2 | 50 |

We claim:

1. A liquid solvent coal extraction process comprising extracting coal with a liquid oil solvent, separating a coal extract solution from the resulting mixture of coal and solvent, catalytically hydrocracking at least a fraction of said solution and recycling a portion of the hydrocracked solution as liquid oil solvent, wherein said portion of hydrocracked solution is thermally cracked at a temperature of from 470° to 540° C. for a time of from 2 to 15 minutes in the absence of added hydrogen, thereby reducing the concentration of saturated polynuclear hydrocarbon species in said portion, and using said thermally cracked solution as solvent for said coal extraction process after said thermal cracking.

2. The process of claim 1, wherein the portion of the hydrocracked solution is thermally cracked under autogenous pressure.

3. The process of claim 2 wherein the pressure is less than 50 bar (g).

4. The process of claim 2 wherein the pressure is less than 20

5. The process of claim 2, when the pressure is less than 10 bar (g).

6. A process as claimed in claim 1, wherein the temperature is from 480° to 520° C.

7. A process as claimed in claim 1, wherein the treatment time is from 3 to 10 minutes.

8. The process of claim 1 wherein the portion of the hydrocracked solution is a cut of the product of hydrocracking containing about 25–75% by weight of cyclic species.

9. The process of claim 8 which is a 250°–350° C. cut of the product of hydrocracking.

* * * * *